US008474167B2

(12) United States Patent
Bertrand

(10) Patent No.: US 8,474,167 B2
(45) Date of Patent: Jul. 2, 2013

(54) INFORMATION DISPLAY DEVICE

(76) Inventor: Ludovic Bertrand, Bonnes (FR)

( * ) Notice: Subject to any disclaimer, the term of this patent is extended or adjusted under 35 U.S.C. 154(b) by 21 days.

(21) Appl. No.: 13/200,007

(22) Filed: Sep. 15, 2011

(65) Prior Publication Data

US 2012/0011755 A1 Jan. 19, 2012

Related U.S. Application Data

(63) Continuation-in-part of application No. 12/226,967, filed as application No. PCT/FR2007/000737 on Apr. 26, 2007, now abandoned.

(30) Foreign Application Priority Data

May 4, 2006 (FR) ..... 06 04016

(51) Int. Cl.
*G09F 7/04* (2006.01)

(52) U.S. Cl.
USPC ..... 40/611.1; 40/600; 52/103

(58) Field of Classification Search
USPC ..... 40/575, 576, 578, 611.01, 611.12, 40/611.13
See application file for complete search history.

(56) References Cited

U.S. PATENT DOCUMENTS

| | | | | |
|---|---|---|---|---|
| 2,128,118 | A * | 8/1938 | Burford | 248/346.11 |
| 3,604,172 | A * | 9/1971 | Matvey | 52/103 |
| 3,856,257 | A | 12/1974 | Wetstone | |
| 3,862,505 | A * | 1/1975 | Jeroma | 40/574 |
| 4,583,309 | A * | 4/1986 | Kane et al. | 40/711 |
| 4,685,234 | A * | 8/1987 | Anderson et al. | 40/625 |
| 5,301,443 | A * | 4/1994 | Gori | 40/308 |
| 5,310,279 | A | 5/1994 | Lindner | |
| 5,316,376 | A * | 5/1994 | Defreitas | 301/37.26 |
| 5,353,535 | A * | 10/1994 | Plumly | 40/600 |
| 5,524,373 | A * | 6/1996 | Plumly | 40/600 |
| 5,623,778 | A * | 4/1997 | Dunn | 40/611.03 |
| 5,676,444 | A * | 10/1997 | Liao | 362/614 |
| 5,678,337 | A | 10/1997 | Ashoori | |
| 5,845,436 | A * | 12/1998 | Nota | 52/103 |
| 5,848,830 | A | 12/1998 | Castle et al. | |
| 6,732,460 | B2 * | 5/2004 | Blakeslee | 40/564 |
| 7,174,665 | B2 * | 2/2007 | Jay | 40/611.01 |
| 8,096,067 | B2 | 1/2012 | Jay | |
| 2006/0239775 | A1 * | 10/2006 | Klassen | 404/7 |
| 2007/0059480 | A1 * | 3/2007 | Potok et al. | 428/67 |

FOREIGN PATENT DOCUMENTS

FR 2 606 540 A1 5/1988

OTHER PUBLICATIONS

International Search Report.

* cited by examiner

*Primary Examiner* — Joanne Silbermann
*Assistant Examiner* — Shin Kim
(74) *Attorney, Agent, or Firm* — Bucknam and Archer

(57) ABSTRACT

There is disclosed an information display device, which comprises a ground attachment structure having a convex upper face, and a cooperating convex removable, transparent top cover, between which an information display support is arranged. The structure is hollowed-out on its upper face with channels enabling water to flow towards openings for discharging water to the ground.

16 Claims, 4 Drawing Sheets

INFORMATION DISPLAY DEVICE

CROSS REFERENCE TO RELATED APPLICATIONS

This application is a continuation-in-part of U.S. application Ser. No. 12/226,967, filed Dec. 1, 2008 now abandoned, which was the National Stage of PCT/FR2007/000737 filed on Apr. 26, 2007, which claims priority of French Application No. 06/04016 filed on May 4, 2006, the subject matter of these applications are herein incorporated by reference. The international application under PCT article 21(2) was not published in English.

BACKGROUND OF THE INVENTION

This invention relates to the design and construction of an information display device. The invention relates more specifically to displaying information down on the ground. The device it proposes is particularly appropriate for outdoor uses, although it may also be used inside buildings.

In a preferred field of application of the invention, the display device is to be placed in car park areas, for instance at the end of the white lines that delimit the parking spaces. In such cases, the device is used as an information support, but, at the same time, it also has the advantage of ensuring a better delimitation of the car spaces.

Meanwhile, the invention does not exclude using the invention device for displaying information on quite different planar surfaces and, in particular, on vertical wall surfaces or up on ceilings.

The device according to the invention is intended for displaying all types of information, and among them more particularly for displaying signalizing information, such as information entailing commercial indications or information about reserved parking places, or for displaying advertising information.

DESCRIPTION OF THE PRIOR ART

It is usual to provide for information on the ground by painting the message directly on the ground. This process shows a major disadvantage in the fact that the message painted on the ground is difficult to modify or eliminate. Furthermore, this process is limited in terms of the style of messages that can be displayed, since it is difficult to paint on the ground complex messages, that involve several colors and fine details for example.

Information display devices are known that are designed to be imbedded in the ground with their top part coming flush with the ground surface. U.S. Pat. No. 3,604,172 discloses markers for cemetery being disposed in a marker-supporting base that is placed in a cavity specially formed in the ground for that purpose. The supporting base is an upwardly open receptacle and water discharging means are provided between the open receptacle and the marker to discharge water entering the receptacle. Watertight display casings are also known, such as described in patent FR 2 606 540, which have a transparent upper face and inside which a label with the message is placed. Such devices are intended for being installed in hollow cavities formed in the ground in predetermined locations. They are particularly appropriate for use inside buildings wherein cavities for housing the casings have been provided during their construction. However, it is very difficult to install such devices in places that have not been equipped therefore beforehand, in particular outdoors, on asphalt road coatings, since in this case, a cavity of the size of the casing must be dug in the ground. This operation is difficult and costly. Furthermore, once the casing has been installed, it is not possible to remove it without having to fill in the cavity.

Other information display devices are known, which however are not adapted to be attached to a planar surface. U.S. Pat. Application Publication No. 2010/0037500 discloses a device to be attached to a restraint bar of a ski-lift chair with clamps. It is to be noted that no means for discharging water is provided in that device.

BRIEF DESCRIPTION OF THE INVENTION

An object of the invention is to overcome the disadvantages of existing ground display systems, and therefore to propose an information display device that may be installed easily on any planar surface, without special preparation of the surface and can then ensure that the information can easily be read as well. An additional object of the invention is to provide for such devices that can support the weight of cars and resist to their riding over them.

In a number of its preferred embodiments the device of the invention comprises a ground attachment structure with a top wall having an upper wall having a curved convex shape and a cooperating removable transparent cover forming a lower surface having a complementary shape, in such a relative configuration as to receive an information label enclosed in between them.

In such embodiments, the legibility of an information printed on the label is increased with little disturbance resulting from the presence of the device on the ground, both for vehicles and for pedestrians.

According to an important feature of the device of the invention, the base structure, which is adapted to be attached resting on the ground, comprises channel means for collecting any water appearing inside the device and let it flow towards evacuation openings provided for discharging it onto the ground.

Advantageously, the channel means are so conformed that there is managed between them in the structure supporting area means on which the cover abuts in the closed position.

Such a configuration of the device according to the invention has several advantages. Thanks to the cover abutting on the supporting area together with the choice of the material which it is preferably made of (advantageously both flexible and strong), the supporting area act as a reinforcement means for the cover which abuts on it, and the strength of the whole is thereby substantially improved. In addition, the cover is advantageously made of an impact resistant material, so that it is not damaged by impacts, in particular by gravel thrown onto it with force.

The device according to the invention is made advantageously so that water entering it (rainwater or ground washing water) is spontaneously rejected out of it through the channel means, which drain it out, in particular with the help of a slight slope, down to evacuation openings through which it is discharged onto the ground. Therefore water which could damage the label does not remain stagnant inside the device.

It is advantageous that the upper face of the device is not fitted with any form of sealing to prevent outside water entering the device, because otherwise, the inner face of the cover would become blurred due to condensation of humidity and any moisture infiltration from the ground or the atmosphere would not be able to evaporate out of the device nor could the water resulting from its condensation during temperature variations escape from it. By avoiding that humidity remain inside the device and letting condensed water flow out of it, the invention leads to an improved legibility of the message on the label over time.

Additionally to that layout, the preferred convex shape of the area means supporting the label on the base structure wall allows that in case of water condensation inside the device the resulting liquid water is drained down to the evacuation openings through the channel means provided around each portion of the support area means and towards the evacuation openings, wherever that water could stagnate.

The device according to the invention therefore advantageously provides for a display of high quality and very good legibility. It may be attached to all types of surfaces, using adhesive or using screws, without the need for any special preparation or fittings. It means no more than a minor hindrance for traffic, thanks to its convex shape and due to its height being preferably quite low and limited for example to a maximum of approximately 20 mm in the central section of the convex shape.

According to the preferred embodiments in industrial practice, the invention also complies with the following characteristics, whether used separately or in each of their technical operative combinations.

The label used is conventional in itself. It should preferably be plastified, so as to make it more resistant to moisture, or it can be made of thick card when dealing with short-life labels, especially those that should last just a few weeks. All types of messages, in particular the more complex, can be displayed using such labels.

According to a preferred embodiment of the invention, the upper face of the label is coated with a layer of adhesive to enable it to be stuck against the lower face of the cover. The legibility of the label is therefore improved still further, since any entrance of moisture between the label and the cover is avoided.

According to an advantageous characteristic of the invention, the cover is attached to the structure by engaging flexible tabs in cooperating housings made in it. The tabs should be long enough so as to only be disengaged from the corresponding openings under the effects of a strong lateral pressure exerted on either side of the cover and, in particular, so as not to be disengaged by simple manual pressure. The device according to the invention therefore advantageously provides a high level of protection against theft of the label by separating the cover and the structure attached to the ground.

According to another advantageous characteristic of the invention, the top wall of the structure comprises, on the outer edge of each of the housings, a slot allowing for pliers to be inserted to disengage the tabs by applying pressure to the opposing sides of the cover and bringing the tabs towards each other. The cover may therefore be easily separated from the structure, using an appropriate tool, when the label needs to be replaced.

Thus, according to the invention, it is advantageously very simple and easy to attach the cover onto the structure or to separate it from it, using an appropriate instrument, whereas it is impossible to separate them by simple manual operations. It should be noted here that the convex shape of the cover plays a significant role in the operation due to induced flexibility.

The device according to the invention is advantageously associated with a special tool for use to remove the cover when attached to the structure. The lower end of the tool comprises elongated control rods that can be operated by a user in the standing position and jaws that are operated simultaneously by a single control operation. The jaws are arranged so that they can be inserted simultaneously in all the slots of the structure, one in each, so as to allow the tabs of the cover to be disengaged from their respective cooperating housings.

The cover may therefore be separated from the structure very comfortably by a user in the standing position, without having to crouch or bend. The extended length of the control rods of the jaws also reduces the effort required to exert on the cover a lateral pressure great enough to disengage the tabs from their respective housings.

The same tool can be used advantageously to install a new cover on a structure already fixed on the ground, again by someone in the standing position.

In the preferred embodiments of the invention, the lower wall of the structure comprises attachment openings which enable to fix it on the ground using screws or adhesive. These attachment openings are advantageously made with the same holes as the evacuation openings for discharging water. The holes that are not used for attachment to the ground are used for discharging water that has entered the device.

All the holes, i.e. both attachment openings and evacuation openings, are covered by the cover when it is in the closed position.

Furthermore, together with the fact that the cover can only be separated from the structure using a special tool, the fact that attachment of the device to the ground is obtained through attachment openings of the base structure that are located under the cover in the closed position, has the advantage of protecting the device against theft once it is installed and fixed on the ground.

Indeed, it is not possible to detach the device from the ground, whether it has been fixed to it by glue or screws, except by first removing the cover to access to the attachment openings and be then able to unscrew the attachment screws or destroy the rivets of adhesive using a drill. The device according to the invention therefore provides a high level of security against theft.

When attachment by adhesive is used, a solid attachment resistant to lateral force exerted on the device by the wheels of vehicles passing over it can be obtained advantageously due to the fact that the adhesive applied between the lower face of the structure and the ground enters the attachment openings and overflows through them inside the device, thereby forming the equivalent of a particularly effective system of rivets after solidification. The device according to the invention leads thus to excellent holding power when it is attached by adhesive.

According to an advantageous characteristic of the invention and with the same objective of solid attachment to the ground, the structure comprises, on the edge of its lower face intended to be in contact with the ground, radial grooves that improve its adhesion on the ground.

A further object of the invention is to provide a label displaying device that when in place on the ground ensures good conditions of safety for people around. For that purpose, in the preferred embodiments of the invention, the cover comprises on its upper face an anti-slipping coating and the structure comprises, at the opposing longitudinal ends of its upper face an anti-sticking pattern, so that the risk of pedestrians slipping or two-wheel vehicles skidding on these parts of the device is avoided.

The device is preferably elongated with a reduced width in the middle, which increases its ergonomics and makes passing over it easier. All its external corners are blunt, so that there is no risk of injury or puncture for users.

In the preferred embodiments of the invention, the cover further comprises on its upper face an anti-scratch coating, which improves the legibility of the label through said cover along time.

Optionally, the lower face of the cover should be fitted with frame means for receiving cooperating tabs provided therefore at the outer edge of the label. Such frames are preferably spaced at regular intervals along the edge of the cover. This advantageously improves the retention of the label against the surface of the cover. The assembly of the label against the cover is also made easier.

Furthermore, and this is highly advantageous from an industrial point of view, the label can be placed in the cover in the factory and the finished assembly can then be transported to the place where the base structure has been attached on the ground to replace a previous cover the label in which has become obsolete.

That results in significant savings in time for the replacement of the label. The replaced cover can then be returned to the factory and be fitted there with a next new label.

In preferred embodiments of the invention, the top wall of the base structure is hollowed-out on its upper face to form a network of water draining channels that constitute the channel means. The upper outer surface of the base structure is thence discontinuous.

Such channels are preferably arranged in accordance with a square pattern. They delimit thereby a plurality of support area members regularly distributed on the outer surface of the base top wall that constitute together the said support area means for supporting the transparent cover and enclose the label there between once the device has been closed by attaching the cover onto the base structure.

Industrially, the top wall of the base structure is preferably formed in a plate of organic glass of uniform thickness and the upper surface of the supporting area members protruding from the channels between them with respective heights and shapes so that together, they form a convex supporting surface for the cover.

That improves the strength of the whole. On the one hand, the supporting area members act as reinforcement means for the cover which abuts on them and, on the other hand, there remain spaces between the supporting area members, which gives the cover some flexibility to deform vertically without breaking when pressure is exerted on it. Thanks to this strength and flexibility of deformation, the device according to the invention resists advantageously to the passage over it of vehicles of several tons without breaking.

In addition, the cover is advantageously made of an impact resistant material, so that it is not damaged by impacts, in particular by gravel thrown onto it with force.

With the same aim of making the device stronger, according to the invention, the supporting area members are advantageously connected in pairs by fine transverse bars. These links are preferably so dimensioned that they come also into contact with the cover in the closed position, so that they reinforce it still further.

The space between the supporting area members left by the water-draining channels may advantageously be used as a receptacle for accessories associated with the device, in particular, for an independent back-lighting system for the label.

As indicated above in connection with the preferred embodiments of the invention, it results from the manufacturing conditions that the supporting area members between the water-draining channels appear hollowed-out on the lower face of the base structure. On the one hand the structure is thereby lighter and cheaper to manufacture, and on the other hand, the device has better flexibility of deformation under the effects of vertical or lateral pressure exerted on it. It is therefore all the more stronger.

In other embodiments of the invention, the outer upper surface of the base structure is not discontinuous. In the top wall of such a base structure for the label displaying device of the invention, a single channel is formed extending all around it as a peripheral channel surrounding an unbroken surface area. Thence the so-called channel means delimit an unbroken single support area member as the supporting area means.

In such case, the top wall is simple and easier to manufacture, but then, it is considered an important feature that its upper surface show a convex shape, upwardly curved at the center along the device axis, so as to allow for an efficient evacuation of the water that could condense above the top wall inside the device when in use.

The lower wall has the form of a honeycomb structure, which comprises lower face of ribs, the ribs extending all over the height of said base structure, from said top wall. It improves strength of the device by assuring a planar lower wall for a correct attachment of the device to the ground.

BRIEF DESCRIPTION OF THE DRAWINGS

The invention will now be described in greater detail in terms of the preferred characteristics and their advantages, with reference to FIGS. 1 to 7, in which.

FULL DESCRIPTION OF THE INVENTION IN TWO EMBODIMENTS

Figure 1:
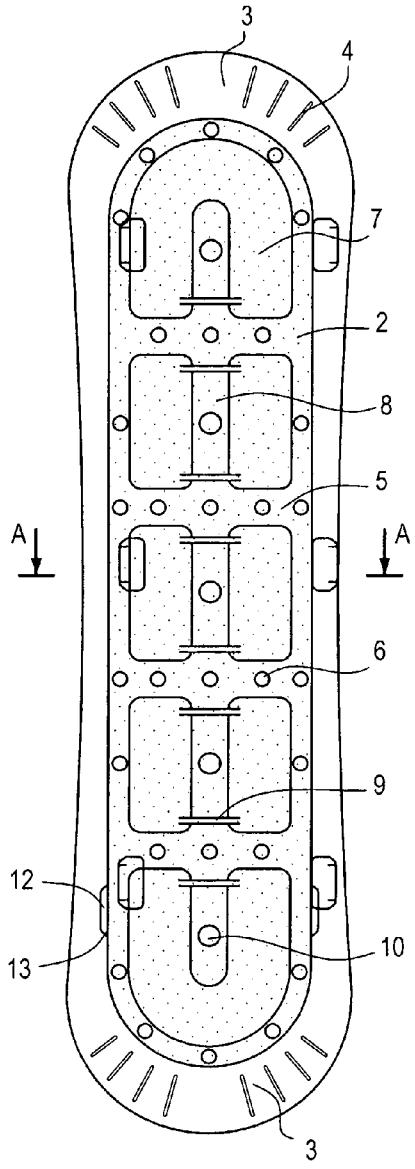
FIG. 1 is a top view of a first embodiment of the device according to the invention.
Figure 2:
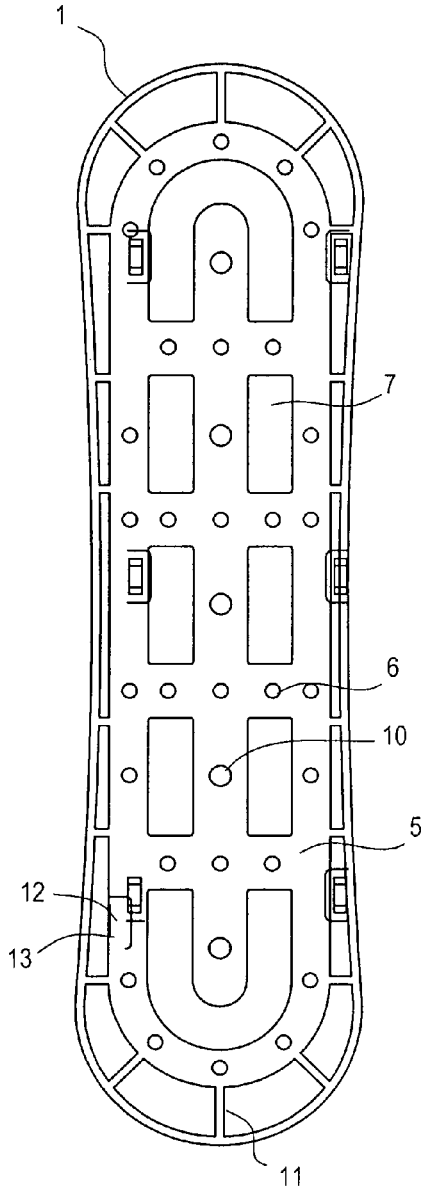
FIG. 2 is a view of the underside face of the device in FIG. 1.

The device according to the invention comprises a base structure member for its attachment flat on a receiving ground or similar surface and a cover member that cooperates with the base structure to close the device and enclose an information support positioned between them. It is to be noted that there is no waterproof sealing between the base structure and the cover.

In the following, the upper and lower faces of each of the two members are considered in relation to an operating position of the display device where it is lying on the ground, with the base structure attached on the ground and the cover in place over it.

An embodiment of the invention is illustrated by FIGS. 1 to 5, wherein the base structure 1 is conformed to provide a top wall with an upper face adapted to receive the cover member resting thereon and a lower wall forming a support plane on its downside face and adapted to lie flat on the ground. However both top wall and lower wall (or bottom wall) are formed as obtained from a single piece of blank which is conformed into raised parts up to a curved upper face and unraised parts down to plane bottom face (said downside face).

The top wall of the base structure 1 appears hollowed-out with communicating channel means open upwards, which comprise channels distributed over its surface and arranged in a square pattern. The channels delimit on the base structure 1 raised supporting area members 7, in such a way that the top wall of the base structure forms a discontinuous supporting area for an information support, i.e. a label or panel. Each of the supporting area members 7 comprises an upper face which is inclined, so as to form the convex top wall of the base structure, as may be seen in FIGS. 3 and 4. The bottom of each channel forms downwards a part of the so-called lower wall of the base structure.

The cover 2 is transparent. It shows a curved convex shape, similar to that of the top wall of the base structure 1, as it can be seen from FIG. 4, which shows a cross-sectional view of the device in a plane transverse to it. The cove is attached to the top wall of the base structure 1 so as to cover it almost entirely while being centered on it.

The shape upwardly curved of the device in the center, due to the convex form of the cover and the top wall of the base structure, makes this device easier to cross over, both for the wheels of vehicles and supermarket trolleys and for pedestrians or bicycles. Furthermore, since the cover rests against the top wall of the base structure, it is more resistant to such vertical pressures as may be exerted on it in use.

An information panel, or signalization label (which is not shown in the figures), is placed between the base structure 1 and the cover 2, with the face on which the information is printed pointing upwards. The panel or label is conventional in itself. Preferably it is coated with a polymer film for long-lasting use outdoors, so as to withstand humidity conditions. The label or panel may also be made of thick card, when the information message it announces is intended to be displayed for only a short period of time.

On its upper face carrying the information to be displayed, the label can have an adhesive layer enabling it to be fixed onto the surface of the cover 2, underneath it. This coating consists, in particular, of a double-side or two-face adhesive tape, one side of which is made to adhere to the label and the other to adhere to the cover. The label, when it is placed between the base structure and the cover, takes the shape upwardly curved of the device, so that the legibility of the information on the label is increased.

In the absence of a label, the supporting area of the base structure 1 is visible through the cover 2, as shown on FIG. 1.

The structure 1 is made of a strong, light material, such as aluminum in particular. As to the cover 2, it is made of a both flexible and impact-resistant polymer material, such as polycarbonate. Its upper face is preferably lined with anti-scratch and anti-slipping coatings.

The device as described herein shows a generally elongated form with reduced width in the middle, which again makes it easier to pass over it. The device thickness is virtually zero at its longitudinal edges and it is up to approximately 20 mm in its central cross-section. Its width and length may vary according to each application. They may for example be approximately 15 cm and 50 to 60 cm respectively.

All angles in the device, are blunt, and thereby there is no risk of injury for persons passing by and no risk of puncture for the tires of cars or other vehicles.

In its opposed longitudinal end parts 3, where the device base structure 1 is not covered over by the cover 2, the base structure 1 is provided with an anti-sticking pattern, comprised of protruding radial corrugations, which reduces the risk of slipping when passing over them.

In use, any water that may have filtered into the device at the intersection of the base structure 1 and the cover 2 is guided by the channels to flow down to holes 6, which are pierced through the structure and which form evacuation openings allowing such water to be drained out of the device and discharged onto the ground.

Figure 3:
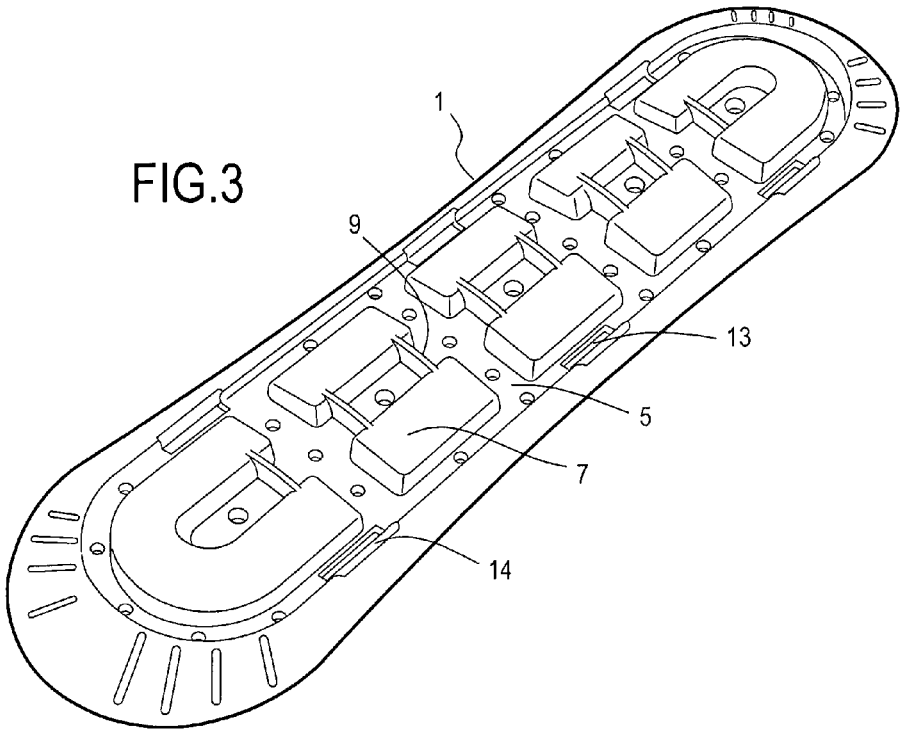
FIG. 3 shows a top view of the ground attachment structure of a device according to the invention in perspective.

The channels are arranged so as to discharge the water efficiently, wherever it has entered. In the embodiment shown in the figures, the channels are arranged in a square network and they comprise a channel 5 extending as a peripheral ring all around the base structure and a central channel 8 that is arranged along the longitudinal center line of the device. As shown in FIG. 3 in particular, these two channels are connected by four transverse channels.

The holes 6 are arranged inside the channels at regularly distributed places all over the bottom side of the structure, so that the water may be discharged through evacuation openings whatever the place where it has entered in the device may be.

The device according to the invention is made so that any water entering it (rainwater or ground washing water) or appearing in it (condensation water from ambiant humidity) is spontaneously rejected out of it by the channels, which drain it to evacuation openings through which it is discharged onto the ground. Therefore water which could damage the label does not remain stagnant inside the device. Furthermore the convex shape of supporting area members contribute to drain water droplets resulting from blurring to the collecting channels and keep the label dry.

The fact that the device is not fitted with any form of sealing to prevent water entering the device advantageously ensures that condensation due to moisture rising up from the ground does not occur on the inner face of the cover. The legibility of the message on the label is thereby improved.

Moreover, channels may be arranged with a slight slope, in such a way that any liquid water in the channel is directed towards an evacuation opening.

The supporting area members 7 arranged on either side of the central channel 8 are connected to each another by fine transverse bars 9, which increase the strength of the structure 1. One or two side bars 9 are provided for each pair of raised areas 7 connected to each other.

Figure 4:
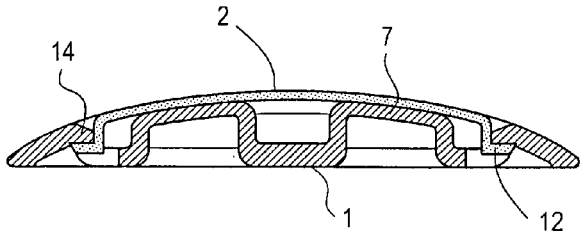
FIG. 4 is a cross sectional view of the device in FIG. 1 according to line A-A.
Figure 5:
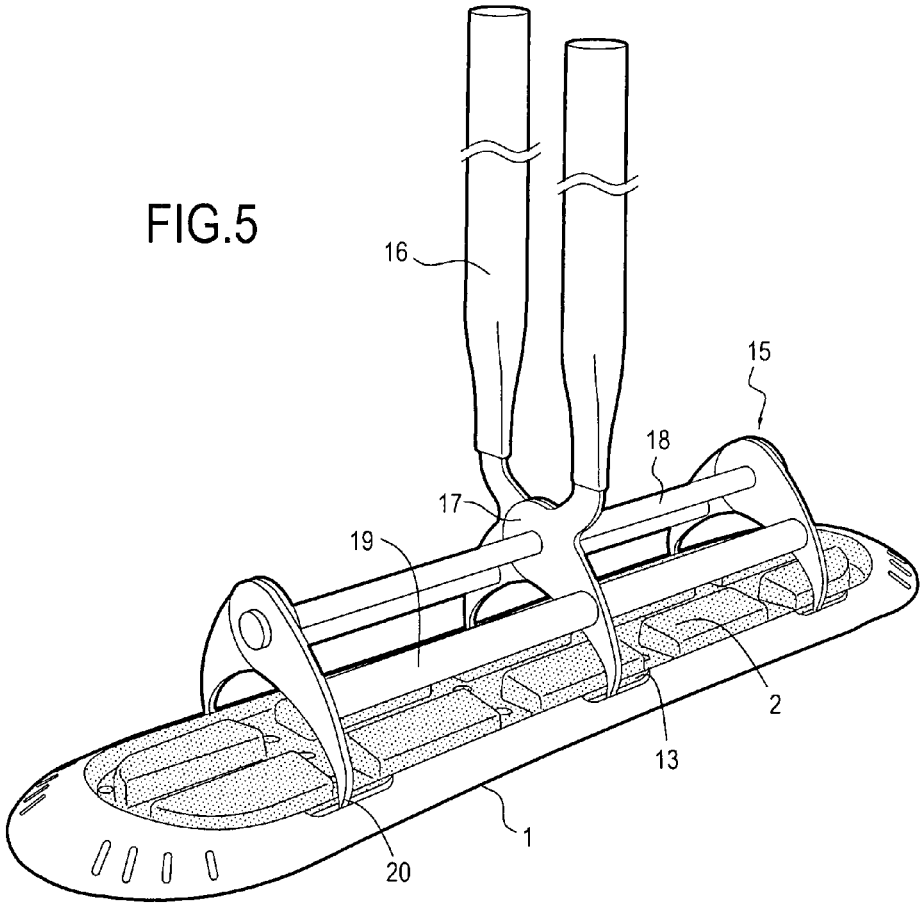
FIG. 5 is a perspective view of a tool according to the invention mounted on the device in FIG. 1, used to separate the cover and the ground attachment structure.

As shown in FIGS. 4 and 5, the supporting area members 7 are hollow, so that the structure 1 is lighter. In that case, it is to be noted that the bottom of the channels form the lower wall of the base structure, here with radial grooves 11 formed at the edge of that lower wall (FIG. 2), which acts in favor of its good adhesion on the ground.

The structure 1 may be attached to the ground by adhesive bonding or using screws.

Bonding is carried out by applying a coat of adhesive glue, conventional in itself for this type of application, under the lower face of the structure 1, along the channels, and pressing on the lower face of the thus coated device against the receiving ground surface. The adhesive is preferably applied at least along one ring under the peripheral channel 5. The adhesive then enters attachment openings made in the channels and it overflows slightly on the upper face of the structure 1, before setting in this configuration, whereby a strong sticking attachment with high bonding power is obtained.

It is to be noted that the base structure comprises through-openings for its attachment to the ground by fixing means such as by adhesive bonding or using screws, and that the cover comes over those attachment openings when it is in its closed position over the base structure. These attachment openings are advantageously of same shape and disposition that the evacuation openings or holes for discharging water. Thus, attachment openings and water discharging holes are interchangeable. The holes that are not used for the attachment to the ground are used for discharging liquid water resulting from moisture that has entered the device.

Additional attachment openings 10 with a slightly greater diameter are provided for attaching the device to the ground using screws. These additional attachment openings are preferably arranged along the longitudinal centre line of the device, in the central channel 8, between the pairs of raised areas 7 and the joining bars 9, so as to provide as strong a screw attachment as possible.

Cover 2 is provided with tabs 12 on its longitudinal edges. In the specific embodiment described here, there are three such tabs 12, that are evenly spaced along each edge. These tabs 12 are intended to be inserted in holes made in the lower wall of the base structure 1, in the peripheral channel 5, and forming cooperating housings 13. Attaching the cover 2 on the structure 1 is carried out simply and easily, by engaging the tabs 12 in the housings 13.

A slot 14 is provided on the upper face of the structure 1, on the outer edge of each housing 13, as shown in FIG. 4. These slots 14 are used to seize the cover 2 above each tab, using pliers, and by exerting a pressure simultaneously above each pair of opposing tabs urging said tabs together, to disengage the tabs 12 from their respective housings, thereby separating the cover 2 from the base structure, to replace the label for example.

The device is associated with a special tool 15 for use to remove the cover 2 from the base structure 1. Said tool is shown on FIG. 5.

It comprises two elongate rods 16, the length of which is sufficient, when the lower end of the tool is placed on the device attached to the ground, to be at the height of the hands of a user in the standing position.

The lower ends of the rods 16 are fitted with three jaws 17, arranged parallel to each other with their gripper arms pointing downwards and hinged on the same shaft 18 perpendicular to the rods 16.

The jaws 17 are also connected on their gripper arms, respectively by the rods 19 parallel to the shaft 18. The rods 16 are connected to the central jaws, so as to open or close the gripping jaws by moving the two rods 16 to and from with respect to each other, and this movement is transmitted to the two other jaws 17 by the rods 19.

Figure 6:
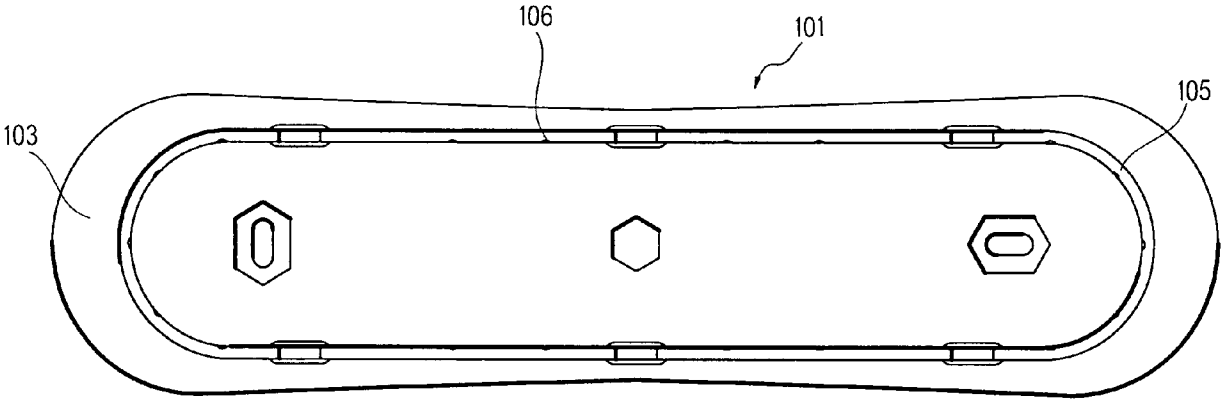
FIG. 6 is a top view of a second embodiment of the device according to the invention.

The jaws 17 are distant from each other and so sized that their grasping ends 20 are each inserted simultaneously in respective ones of the slots 14, as shown by FIG. 6, so that the cover 2 is seized above the tabs 12 to disengage them from the housings 13.

Figure 7:
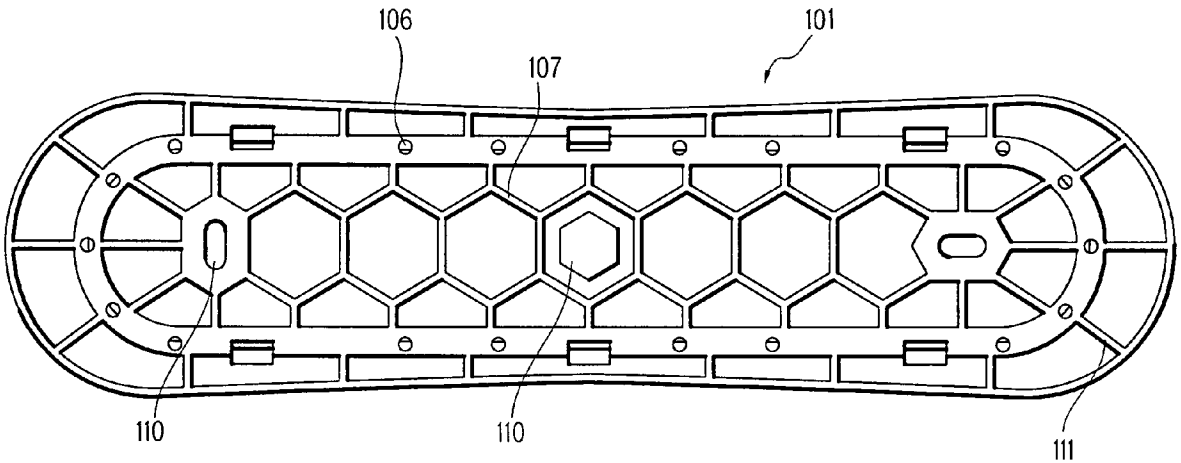
FIG. 7 is a view of the underside face of the device in FIG. 6.

We are now going to describe another embodiment of the invention, which differs from the previous embodiment in the conception of the base structure, such as it is illustrated on FIGS. 6 and 7. This base structure 101 has specific characteristics but it can be advantageously used, for the good legibility of the information on the label, with the cover and the specific tool such as they were described for the previous embodiment.

The cover is attached to the top wall of the base structure 101 so as to cover it almost entirely while being centered on it, as it is disclosed in the first embodiment. And the information label is placed sandwiched between the base structure and the cover, with its lower face applied on the top wall of the structure and its upper face pressed down by the cover.

The base structure 101 comprises a convex top wall adapted to receive the cover and a planar lower wall adapted to lie on the ground. The convex shape complementarity of the base structure and the cover has advantages, as disclosed here above, in terms of legibility of the information on the label and resistance to vertical pressures exerted on the device.

Here, the top wall forms an unbroken supporting area, only delimited by a single channel 105, which extends as a peripheral ring at the bottom of the base structure, downside.

Through-openings for discharging water are arranged inside the peripheral channel 105 at regularly distributed places over the bottom wall surface of the structure, and it is this single channel which enables water to flow towards evacuation openings for discharging water onto the ground.

The base structure 101 is illustrated with smooth opposed longitudinal end parts 103, but it may be provided with an anti-sticking pattern, comprised of protruding radial corrugations, in order to reduce the risk of slipping when passing over them.

The base structure 101 may be attached to the ground by adhesive bonding or using screws, and the adhesive then enters attachment openings made in the channel and it overflows slightly on the upper face of the structure 101, before setting in this configuration, whereby a strong sticking attachment with high bonding power is obtained. The attachment openings provided for attaching the device on the ground are advantageously the same as those provided as the evacuation openings for discharging water. The holes 106 that are not used for the attachment to the ground are available for letting out the water that has collected in the channel.

Additional attachment openings 110 with a slightly greater diameter are provided for attaching the device to the ground using screws. These additional attachment openings are three in number and comprise a central attachment opening and two lateral attachment openings, all arranged along the longitudinal center line of the device, so as to provide a strong screw attachment.

The lateral attachment openings extend all over the height of the base structure, from the top wall to the lower wall. They both have an oblong shape, and one of them has a perpendicular orientation, in order to make easier the attachment to the ground.

It is to be noted that in this embodiment, as previously, it is not necessary to realize beforehand in the ground a cavity for receiving the base structure. The assembling is made simply by sticking the base structure to the ground without using other elements than screw or glue, which could project beyond the base structure. All the openings, the ones used for discharging water and thus the ones used for attaching the device to the ground, are covered when the cover is in a closed position over the base structure and comes thereby over all said openings. So, the device is particularly safe because the means for attachment are not accessible when the cover rests on the base structure, in a closed position.

The lower wall of the base structure comprises on the edge grooves radial roads 111 helping the adhesion of the structure to the ground. The lower wall also comprises the lower face of ribs 107 which extend from the top wall and which form a honeycomb structure. This layout allows on the one hand to stiffen the structure so that it can afford loads at the passage of cars, and on the other hand to lighten the whole device.

The description above clearly explains how the invention can reach the objectives fixed for it. In particular, it provides a device for the display of information on the ground, which may be used easily outdoors and on all types of surfaces without sinking a cavity, which ensures a display of great quality, with good legibility of the information and which is of no nuisance for users but resistant enough for its use in car park areas.

In particular, the device allows to realize a good water discharging thanks to the layout of the device where the cover is fixed to the base structure at the level of the peripheral channel, in such a way that the infiltrated water is directed into this channel which evacuates it towards the evacuation openings. The device also allows a good evacuation of the water resulting from condensation, if such water is formed in spite of the advantageous conception without waterproof sealing between the structure and the cover in closed position. The convex shape of the top wall of the structure allows managing this water of condensation towards the peripheral channel, or towards the potential additional channels. Besides, the slope which can be advantageously formed in channels makes faster the discharging of water towards evacuation openings and thus outside the device.

The holes for discharging water are interchangeable with the ones for attaching the device, but the total number of these holes is sufficient so that some are not used as attachment openings but have only a function of discharging water, as evacuation openings. All these openings are under the cover when it is in a closed position on the base structure, which is particularly safe because the device can be removed from the ground only if the cover has been first removed from the base structure and that is impossible without using the specific tool.

In both preferred embodiments described above the base structure members remain fixed to the ground for receiving interchangeable cover members, each carrying a specific information support constituted by a label stuck under it, on its downside face.

The device according to the invention may in particular, be fitted with solar sensors connected to batteries which may be placed in the channels, between the supporting area members when the top wall is discontinuous. These batteries may supply a system of button lights installed inside of the device, under the label, so as to make it legible in darkness by backlighting and/or a system for broadcasting audio messages also installed between the supporting area members.

The device may also comprise diodes placed in the openings provided at its ends in particular, so as to provide more effective visual delimitation of parking spaces.

Nevertheless, it is clear from the above description that the invention is not limited to the embodiments that have been specifically described and represented in the figures, and on the contrary, it applies to any variant using equivalent means.

The invention claimed is:

1. An information display device, comprising a base structure member for attaching said device flat on the ground and a removable cooperating cover member for covering said base member and closing said device in a non waterproof manner and receive an information support inserted between an upper face of said base structure member and said cover member, wherein:

said base structure forms a lower wall with a downside face for plane contact with the ground when attached thereto, said lower wall comprising attachment openings for passing fixing means therethrough and thereby attach said device onto the ground, and a top wall comprising channel means hollowed-out from said upper face down to said lower wall, for collecting any water appearing in said device and let it flow down to evacuation openings for discharging it onto the ground, whereby support area members are delimited by said channels in said upper face for supporting said cover and said information support while elements of said lower wall are formed by said channel means, and said cover member is so conformed as to come over all said attachment openings and water discharging openings when the device is closed.

2. A device according to claim 1 wherein said top wall of the base structure member has an elongated curved convex shape and said cover member is comprised of a transparent removable cover having a complementary curved convex shape and is supported by said base structure member on the upper face thereof when closing the device, with said information support interposed between said cover member and said support area members of said base structure top wall.

3. A device according to claim 2 wherein said base structure member comprises holes through its lower wall that are interchangeable for use as attachment openings for attaching said device to the ground by means of screws and/or adhesive and as evacuation openings for discharging water collected in said channel means onto the ground.

4. The device according to claim 1, wherein said channel means are made with a slope downwards to facilitate water draining towards said evacuation openings.

5. The device according to claim 1, wherein said upper cover member comprises a transparent upper cover letting information printed on said information support be seen through it which is made of a flexible impact resistant polymer material with sufficient strength to withstand ground traffic.

6. The device according to claim 1, wherein said base structure member comprises, on the edge of its lower wall, radial grooves which improve its adhesion on the ground and said cover comprises on its upper face an anti-scratch and anti-slip coating, and wherein said base structure comprises, at the opposing longitudinal ends of its top wall, an anti-sticking pattern.

7. The device according to claim 1, wherein said cover member is attached to said base structure by engaging flexible tabs in cooperating housings provided therefore in said base structure member and wherein said base structure member comprises on its top wall, on the outer edge of each of said housings, a slot allowing for pliers to be inserted to disengage said tabs by pressure on the opposing sides of said cover member.

8. The device according to claim 7, characterised in that it is associated with a special tool for the separation of said cover member from said base structure member when attached to the ground, said tool comprising, downwards extending control rods for use by a user in the standing position to operate jaws that are operated simultaneously by the same control operation and are arranged so as to enable them to be inserted simultaneously respectively in all said slots of said base structure member, so as to engage or disengage said tabs from said housings.

9. The device according to claim 2, wherein additional attachment openings are made with a larger diameter than said evacuation openings, said additional attachment openings being arranged along the longitudinal central line of said device through the bottom wall of a central channel of said channel means which is covered by said elongated cover when closing said device.

10. An information display device, comprising a base structure for attaching said device flat on the ground and a removable cooperating cover for covering said base member and closing said device in a non waterproof manner and receive an information support inserted between an upper face of said base structure member and said cover member, wherein said base structure forms a lower wall with a plane downside face for flat contact with the ground when attached thereto and an elongated top wall with support area members for said cover forming said upper face, and wherein said base structure comprises channel means hollowed-out in said top wall for collecting any water appearing inside said device and let if flow down to evacuation openings provided through said lower wall for discharging said water onto the ground, wherein said channel means comprise a peripheral ring channel, a central channel arranged along the longitudinal axis of said elongated top wall, and transverse channels which connect said peripheral ring and said central channel, so that said channels are arranged in a square pattern in the top wall and delimit said support area members, said upper face of the base structure top wall being thereby discontinuous and formed by said area members as hollowed out from said lower wall.

said base structure further comprising attachment openings provided for attaching said device to the ground, said attachment openings as well as said evacuation openings all being holes through said lower wall in said channels, whereby said holes are interchangeable for use as attachment openings for attaching said device to the ground by means of screws and/or adhesive and as evacuation openings for discharging water collected in said channel means onto the ground and whereby said evacuation openings and said attachment openings are covered by said cover when closing said device.

11. A device according to claim 10 wherein said top wall of the base structure member has an elongated curved convex shape and said cover member is comprised of a transparent removable cover having a complementary curved convex shape and is supported by said base structure member on the upper face thereof when closing the device, with said information support interposed between said cover member and said support area members of said base structure top wall.

12. A device according to claim 11 wherein said information support is carried by said cover and stuck on the underside face thereof.

13. The device according to claim 10, wherein said cover is attached to said base structure by engaging flexible tabs in cooperating housings provided therefore in said base structure and wherein said base structure member comprises on its top wall, on the outer edge of each of said housings, a slot allowing for pliers to be inserted to disengage said tabs by pressure on the opposing sides of said cover.

14. An information display device, comprising a base structure having a planar lower wall for flat contact with the ground and a convex top wall for receiving an information label and supporting an transparent upper cover cooperating with said base structure to removably close said device in a non waterproof manner and displaying said information label through said cover, wherein:

(a) said base structure comprises a ring channel hollowed-out from said top wall which extends along its periphery and delimits a support area as an unbroken upper face for supporting said cover with said label being interposed between said top wall and said cover, said channel being adapted to collect any water present inside the device and let it flow down to evacuation openings provided through said lower wall to discharge said water onto the ground, said base structure comprising attachment openings provided for attaching said device to the ground, said attachment openings as well as said evacuation openings all being holes through said lower wall in said channels, whereby said holes are interchangeable for use as attachment openings for attaching said device to the ground by means of screws and/or adhesive and as evacuation openings for discharging water collected in said channels onto the ground and whereby said evacuation openings and said attachment openings are covered by said cover when closing said device, (b) and wherein said upper cover and said support area in said top wall have complementary surfaces with curved convex shape so that said cover when closing the device abuts against said supporting area of said base structure to position said label between said upper cover and said supporting area while draining any water down to said ring channel.

15. The device according to claim 14, wherein said lower wall has the form of a honeycomb structure which comprises lower face of ribs, and wherein said ribs extend all over the height of said base structure, from said top wall.

16. The device according to claim 14, wherein said cover is attached to said base structure by engaging flexible tabs in cooperating housings provided therefore in said base structure and wherein said base structure member comprises on its top wall, on the outer edge of each of said housings, a slot allowing for pliers to be inserted to disengage said tabs by pressure on the opposing sides of said cover.

* * * * *